US007121034B2

(12) United States Patent
Keng

(10) Patent No.: US 7,121,034 B2
(45) Date of Patent: Oct. 17, 2006

(54) BIPOD MOUNT AND GRIP ASSEMBLY

(76) Inventor: Da Keng, 875 Wharton Dr. SW., Atlanta, GA (US) 30336

( * ) Notice: Subject to any disclaimer, the term of this patent is extended or adjusted under 35 U.S.C. 154(b) by 0 days.

(21) Appl. No.: 11/056,134

(22) Filed: Feb. 14, 2005

(65) Prior Publication Data

US 2005/0188588 A1 Sep. 1, 2005

Related U.S. Application Data

(60) Provisional application No. 60/543,571, filed on Feb. 12, 2004.

(51) Int. Cl.
*F41C 23/00* (2006.01)

(52) U.S. Cl. ..... 42/71.01; 42/72; 42/94; 89/37.04

(58) Field of Classification Search ..... 42/71.01, 42/72, 73, 90, 94; 89/37.03, 37.04; 16/422, 16/426; 74/543
See application file for complete search history.

(56) References Cited

U.S. PATENT DOCUMENTS 6,397,505 B1 * 6/2002 Stratton et al. ..... 42/47
6,487,807 B1 * 12/2002 Kopman et al. ..... 42/94
2005/0241206 A1 * 11/2005 Teetzel et al. ..... 42/72

FOREIGN PATENT DOCUMENTS

DE 10310802 A1 * 9/2004

* cited by examiner

*Primary Examiner*—J. Woodrow Eldred
(74) *Attorney, Agent, or Firm*—Jones Tullar & Cooper, PC

(57) ABSTRACT

A grip and bipod mounting device for mounting a bipod supporting grip assembly to a "picatinny" mounting rail structure as are often affixed below the forearm stock of a firearm such as a military rifle (e.g., as per standard MIL-STD-1913). In particular, the present invention is directed to mounting a Parker-Hale style of firearm bipod on a bipod supporting grip assembly including a contoured mounting block segment inletted to cover and attach to a picatinny rail affixed beneath the forearm stock of the firearm. A grip or handle depends transversely from the mounting block segment and has a plurality of evenly spaced circumferential band-shaped outwardly projecting surface features. The bipod supporting grip assembly is releasably attachable to a bipod frame by means of a quick release connector such as a bayonet lock or similar locking means. The bipod frame includes a pair of extensible/retractable legs, each having a pair of telescoping sections to enable the height of the bipod to be adjustable as desired.

12 Claims, 5 Drawing Sheets

BIPOD MOUNT AND GRIP ASSEMBLY

RELATED PATENT AND PENDING PATENT APPLICATION INFORMATION

This application claims priority to provisional patent application No. 60/543,571, filed Feb. 12, 2004, the entire disclosure of which is incorporated herein by reference. This application is owned by the applicant/owner of U.S. Pat. No. 5,711,103 and U.S. Pat. No. 5,815,974, the entire disclosures of which are incorporated herein by reference. Additionally, this application is owned by the applicant/owner of provisional application No. 60/338,153, filed Nov. 13, 2001, the entire disclosure of which is also incorporated herein by reference.

BACKGROUND OF THE INVENTION

1. Field of the Invention

The present invention relates to firearm accessories and support devices such as pistol-style grips and bipods, and more particularly, relates to a grip assembly for attaching a pistol-style grip and bipod support to a mounting rail structure affixed to the forearm stock of a firearm. The grip assembly attaches to the rail structure and enables quick attachment and detachment of the bipod to the firearm without modification of the rail structure or forearm stock of the firearm.

2. Background of the Invention

Large caliber or select fire automatic firearms are difficult to control when firing and muzzle rise can cause the marksman to shoot above an intended point of aim. Controlling muzzle rise has been accomplished in the prior art by using a pistol-style grip at a fixed location under the barrel, near the muzzle, as best epitomized by the police version of the famed Thompson® sub-machinegun. While a permanently fixed pistol-style grip serves well in some situations; it limits the usefulness of the weapon and is not well suited for precise aiming.

When shooting firearms, especially in stressful tactical situations, it is important that the firearm be maintained in a steady, stable position to insure accuracy of aim. Most shooters are not able to hold a firearm consistently in a set position without wavering, especially after the onset of fatigue.

Accordingly, peripheral support devices have been used in conjunction with firearms since the early creation of firearms as a means of stabilizing a firearm to reduce vibration, wavering, etc., and to improve accuracy. In the past, shooters have used everything from large stationary objects such as rocks and tree branches to forked sticks, shooting slings, bipods and tripods. Early bipod and tripod supports typically were somewhat crude strands that generally were bulky, inconvenient and difficult to use and typically were not easily adjustable. In more recent times, bipod supports have been developed that are compact and relatively lightweight and are mountable to the forearm stock of a firearm, such as a rifle, to make the bipods portable with the firearm. Most conventional bipod supports include a pair of legs that can be pivoted from an up position adjacent the firearm stock, to a down position engaging a support surface, with the legs also being extensible to adjust the height of the support.

A problem with conventional grips and bipods has been inability to mount either a grip or bipod to most firearms without requiring the use of special mounting tools and the machining or modification of the firearm stock to accommodate the grip or bipod. Additionally, most grips or bipods are not designed for quick and easy attachment and release from a firearm's stock. For example, U.S. Pat. No. 5,194,678 discloses a bipod assembly that includes legs that are pivotable independently of one another for ease of adjustment, but which is not easily attached/detached from the firearm. Other types of conventional bipods offer varying types of mountings that can be fitted to various types of rifles without requiring modification or machining of the rifle stock. For example, Harris Engineering, Inc. manufactures a series of bipod mounts for use with a variety of different firearms. However, these bipod mounts do not provide for the quick-release of the bipods from the firearm.

One of the most popular bipods on the market has been the Parker-Hale bipod assembly. This bipod includes a pair of telescoping legs attached to a mounting frame, and a mounting block for mounting the bipod to the firearm. The mounting block of the Parker-Hale bipod is releasably attached to the mounting frame of the bipod to enable quick attachment/release of the legs of the bipod from the firearm. The problem with the Parker-Hale bipod is that to mount the bipod to a firearm, the forearm stock of the firearm generally must be modified to mount a track or slide therein, along which the mounting block is received to mount the bipod to the firearm; this leaves no room for a grip. In addition, such modifications generally are expensive and often must be done by specialty gunsmiths and can mar the finish of the firearm.

Another problem often encountered with the bipods of the prior art is that the attachment to the firearm (e.g., rifle) is defined by a union of substantially perpendicular lengths of steel. When a shooter assumes the prone position, for example, the optimum results are obtained by forcing the forward hand distally, usually against the front mounting point of a sling, thereby creating a tension in the shooter's body to support the rifle and steady the point of aim. If a shooter were to force his or her forward hand against the perpendicular steel parts of the prior art bipods, the result would be a painful grip against irregularly shaped parts having no ergonomic benefit for the shooter.

This situation is compounded for military or police shooters using military or SWAT rifles carrying special mounts known as picatinny rails under the rifle forearm; the picatinny rails are customarily used for mounting grenade launchers, lights or other accessories and so the rifles often weigh much more than the lighter sporting arms most shooters are used to carrying.

Accordingly, it can be seen that a need exists for a grip and bipod mounting device for selectively attaching a grip and bipod to a firearm adapted for use in military or SWAT situations, where the shooter may need either to control muzzle rise or, for precision aiming, to have a stable support. Ideally, the attachment should not require extensive modification to the firearm such as machining of the forearm stock of the firearm. Preferably, a bipod-mounting device would also enable quick attachment and detachment of the bipod to the firearm.

SUMMARY OF THE INVENTION

The present invention comprises a grip and bipod mounting device for mounting a bipod supporting grip assembly to a "picatinny" mounting rail structure as are often affixed below the forearm stock of a firearm such as a military rifle (e.g., as per standard MIL-STD-1913). In particular, the present invention is directed to mounting a Parker-Hale style of firearm bipod on a bipod supporting grip assembly including a contoured mounting block inletted to cover and attach to a picatinny rail affixed beneath the forearm stock of the firearm. The bipod supporting grip assembly is releasably attachable to a bipod frame by means of a quick release connector such as a bayonet lock or similar locking means. The bipod frame includes a pair of extensible/retractable legs, each having a pair of telescoping sections to enable the height of the bipod to be adjustable as desired.

The bipod supporting grip assembly of the present invention generally comprises an elongate transversely projecting handle or grip terminating proximally in an integral mounting block surrounding a hardened yoke adapted to slide over and receive a picatinny rail. The yoke is releaseably affixed to and hangs from the picatinny rail and is received within a box shaped recess or aperture formed on the upper side surface of the mounting block of the bipod supporting grip assembly. The yoke includes a substantially square-shaped base plate of a size slightly less than the size of the recess formed in the mounting block, and includes first and second parallel sidewalls extending upwardly from the base plate. The base plate is a substantially flat hardened metal (e.g., steel) plate having, in one embodiment, a threaded opening or bore formed approximately through the center thereof. In a preferred embodiment, a five and one-half inch long threaded stud is threadably attached to and projects downwardly or distally from the yoke base plate.

The bipod supporting grip assembly of the present invention includes a forwardly projecting spigot to releasably carry a bipod. The mounting block and integral transversely projecting grip have a bore passing through the long dimension of the grip or handle and dimensioned to receive the yoke's five and one half inch long threaded stud; the bore passes downwardly or distally from mounting block aperture for the yoke.

The yoke base plate first and second sidewalls include inwardly facing v-shaped grooves and are spaced apart; the sidewalls are adapted to fit about and slidably straddle the sides of the picatinny rail mounted to the forearm stock of the firearm, with the length of the rail being received between the first and second side walls. The picatinny rail is a standard element of the military firearm and comprises a mounting rail structure (per standard MIL-STD-1913) having evenly spaced transverse grooves or troughs of standard size. The picatinny rail normally is used for attaching a variety of accessories such as lights, grenade launchers and other devices.

The bipod supporting grip assembly yoke of the present invention preferably has side walls with first and second transversely aligned horizontal fastener openings through which first and second transverse pins or fasteners are received and attached to the side walls, with the shank of the transverse pin extending through the spaced transverse grooves of the rail, to attach the yoke to the rail.

Once the yoke has been attached to the picatinny rail of the firearm and placed in a selected fore/aft position, the mounting block of the bipod supporting grip assembly is placed over the yoke, with the yoke received within the recess formed in the upper surface of the mounting block. The resulting attachment of the grip assembly mounting block to the forearm stock provides a quick and easy attachment of the mounting block to the firearm and enables the mounting block to mount securely to the forearm stock of the firearm in a stable, secure selected position. This prevents the mounting block, integral transversely projecting grip and thus the bipod, from shifting fore and aft or wobbling during use.

With the mounting block securely mounted to the forearm stock of the firearm, the bipod is placed in locking engagement with the mounting block spigot to mount the bipod to the firearm. Optionally, a detachable sling loop can be provided with the securing bolt assembly for attachment of a rifle sling to the stock of the firearm.

Various objects, features and advantages of the present invention will become apparent to one skilled in the art upon a review of the following specification, when taken in conjunction with the accompanying drawings.

DETAILED DESCRIPTION OF A PREFERRED EMBODIMENT

Figure 1:
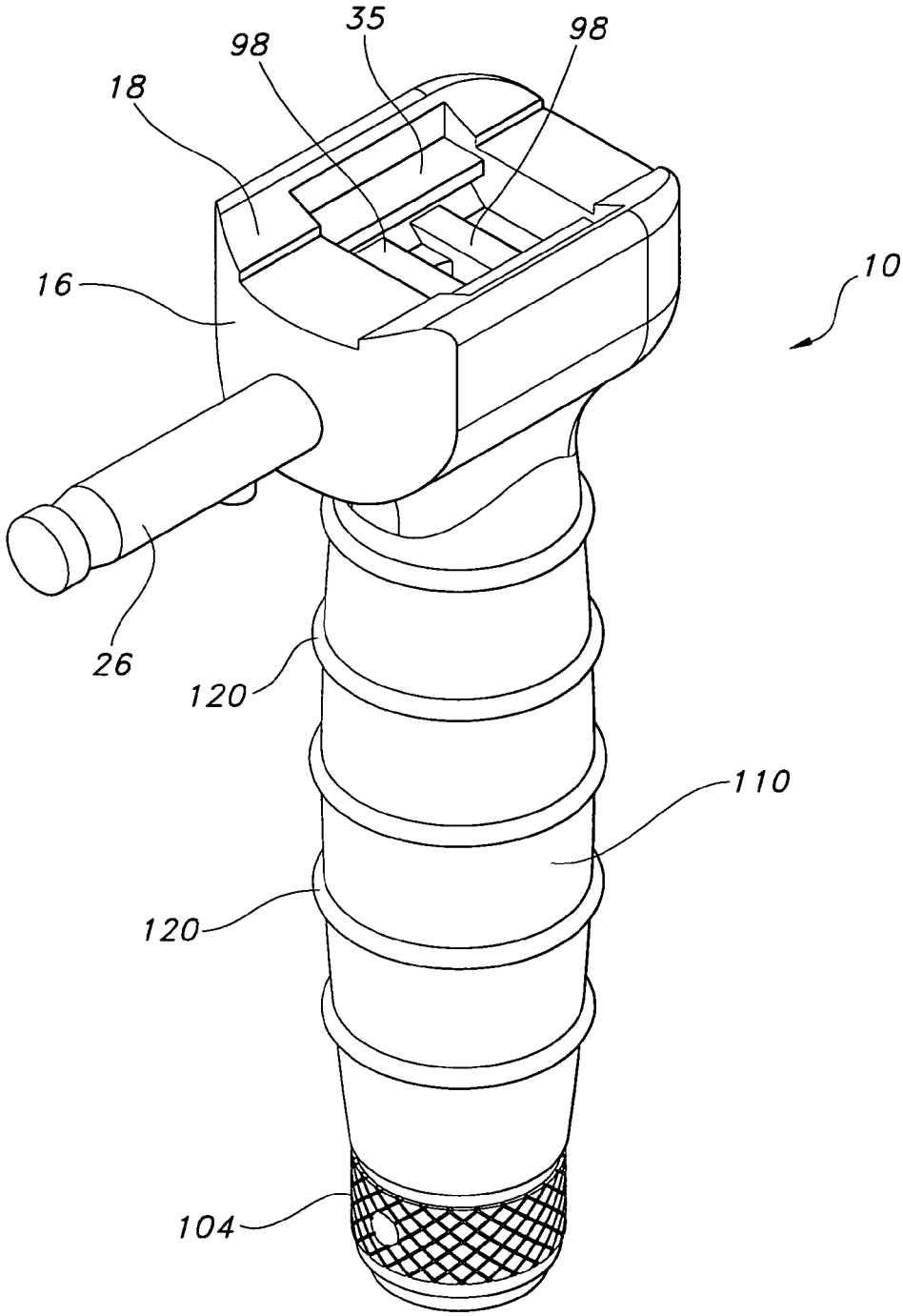
FIG. 1 is a perspective view illustrating a bipod supporting grip assembly, in accordance with the present invention.
Figure 4:
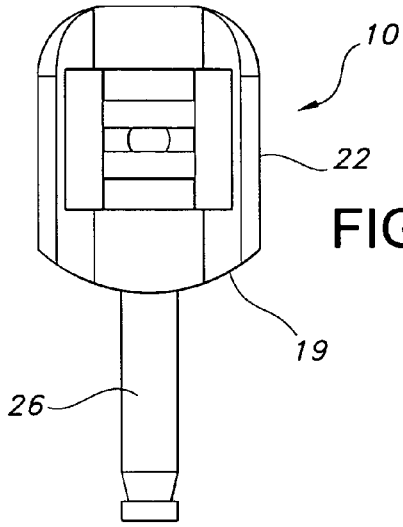
FIG. 4 is top or end view, in elevation, of the bipod supporting grip assembly shown in FIGS. 1–3, in accordance with the present invention.
Figure 2:
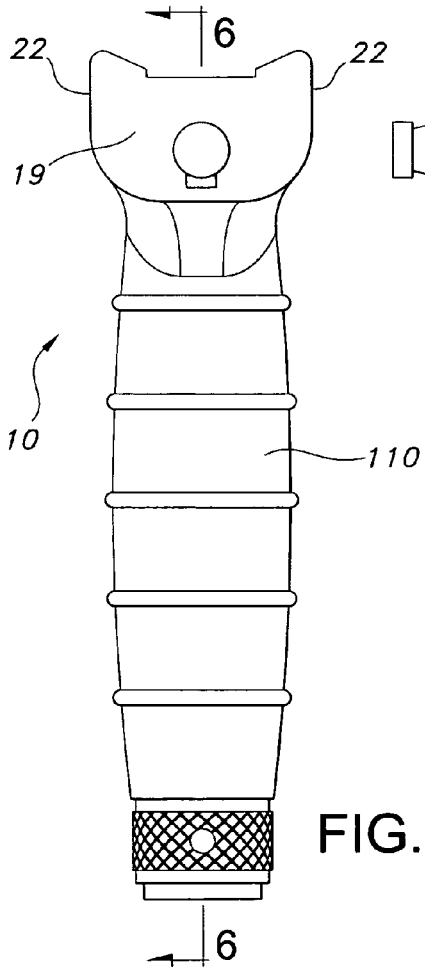
FIG. 2 is front view, in elevation, of the bipod supporting grip assembly shown in FIG. 1, in accordance with the present invention.
Figure 3:
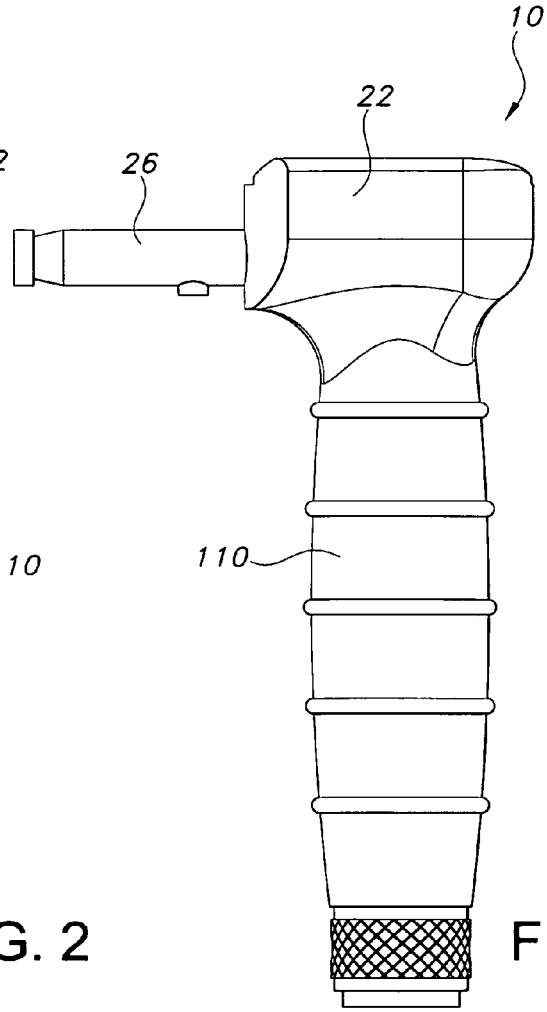
FIG. 3 is a side view, in elevation, of the bipod supporting grip assembly shown in FIGS. 1 and 2, in accordance with the present invention.

Referring now to FIGS. 1–7 in which like numerals indicate like parts throughout the several views, the present invention comprises a bipod supporting grip assembly 10 for mounting, carrying and supporting bipod frame to a firearm such as a rifle (not shown). The bipod supporting grip assembly 10 is releasably mounted to the forearm stock portion of a firearm or other instrument carrying a mounting rail A releasable bipod mounting frame adapted for connection to bipod supporting grip assembly 10 is widely known as a Versa-Pod® brand bipod and has first and second extendable legs as described in co-owned U.S. Pat. Nos. 5,711,103 and 5,815,974, the entire disclosures of which are incorporated herein by reference.

Bipod supporting grip assembly 10 includes an integral mounting block 16 segment that generally is a substantially rectangularly-shaped block typically formed from plastic, fiber-filled resin or similarly durable, weather resistant materials. The mounting block segment 16 preferably includes a curved, concave upper surface 18, front surface 19, a bottom surface (from which grip or handle 110 projects transversely or downwardly), side surfaces 22 and a rear surface 23. As illustrated in FIGS. 1–7, rear surface 23 of mounting block 16 is substantially planar but can also be curved inwardly and include shaved wing portions on either side thereof, so as to give the rear surface 23 of the mounting block a contour and shape adapted to fit to the web of the hand of a shooter when a shooter holds the firearm along its forearm stock portion. The mounting block thus is configured so as to enable the shooter to easily and securely grip the forearm stock portion of the firearm when the mounting block is attached thereto, without interfering with the gripping of the firearm by the shooter. The mounting block further includes an elongate mounting post 26 that is mounted to and extends forwardly from the front surface 19 of the mounting block. The mounting post 26 generally is a cylindrically-shaped steel or hardened metal rod adapted to engage and lock into a locking means or adjustable clamp 27 of the bipod mounting frame, to releaseably carry the bipod frame, as described in the Versa-Pod® patents, cited above and incorporated herein by reference.

Figure 5:
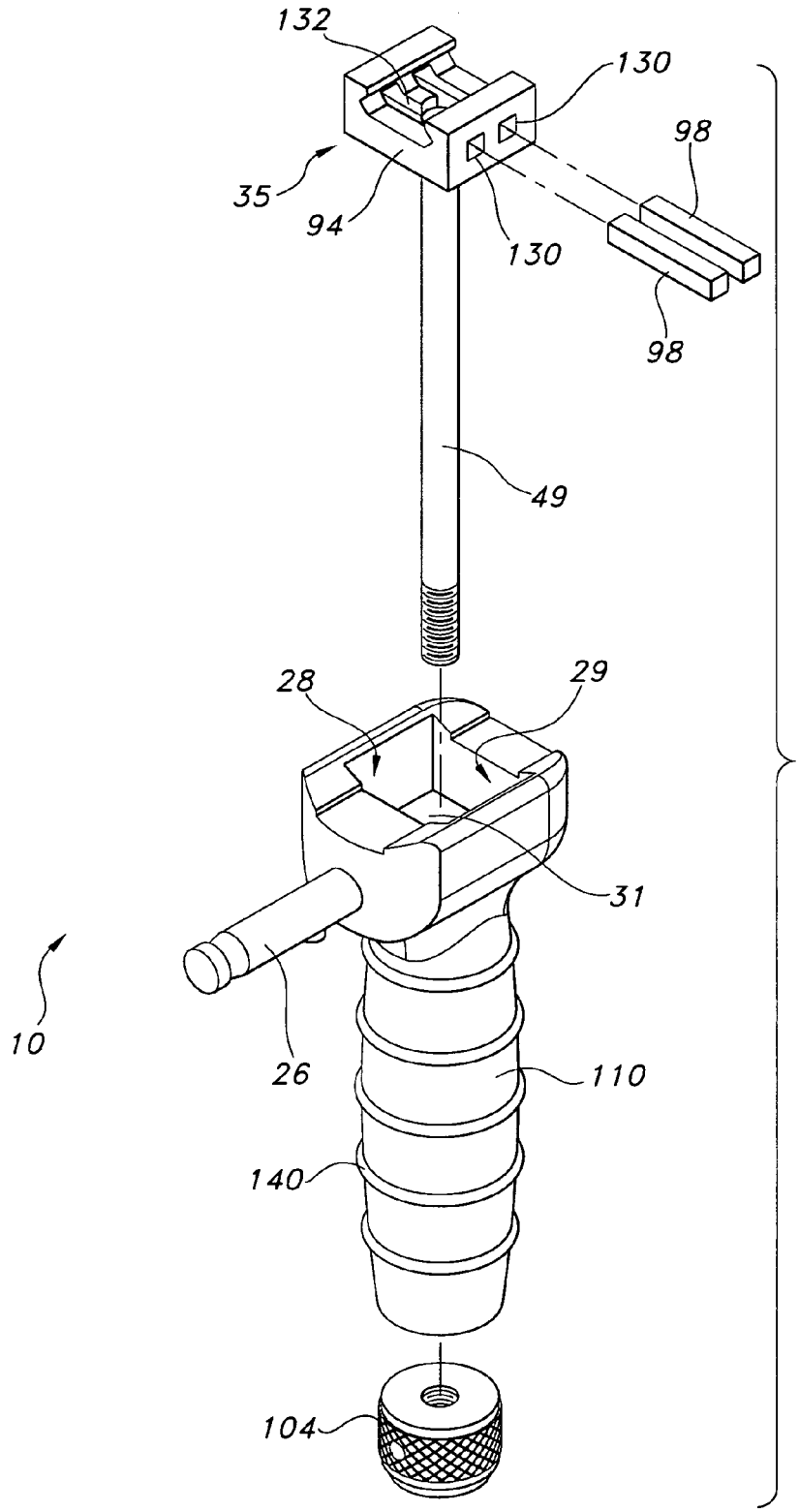
FIG. 5 is an exploded perspective view illustrating the bipod supporting grip assembly shown in FIGS. 1–4, in accordance with the present invention.
Figure 6:
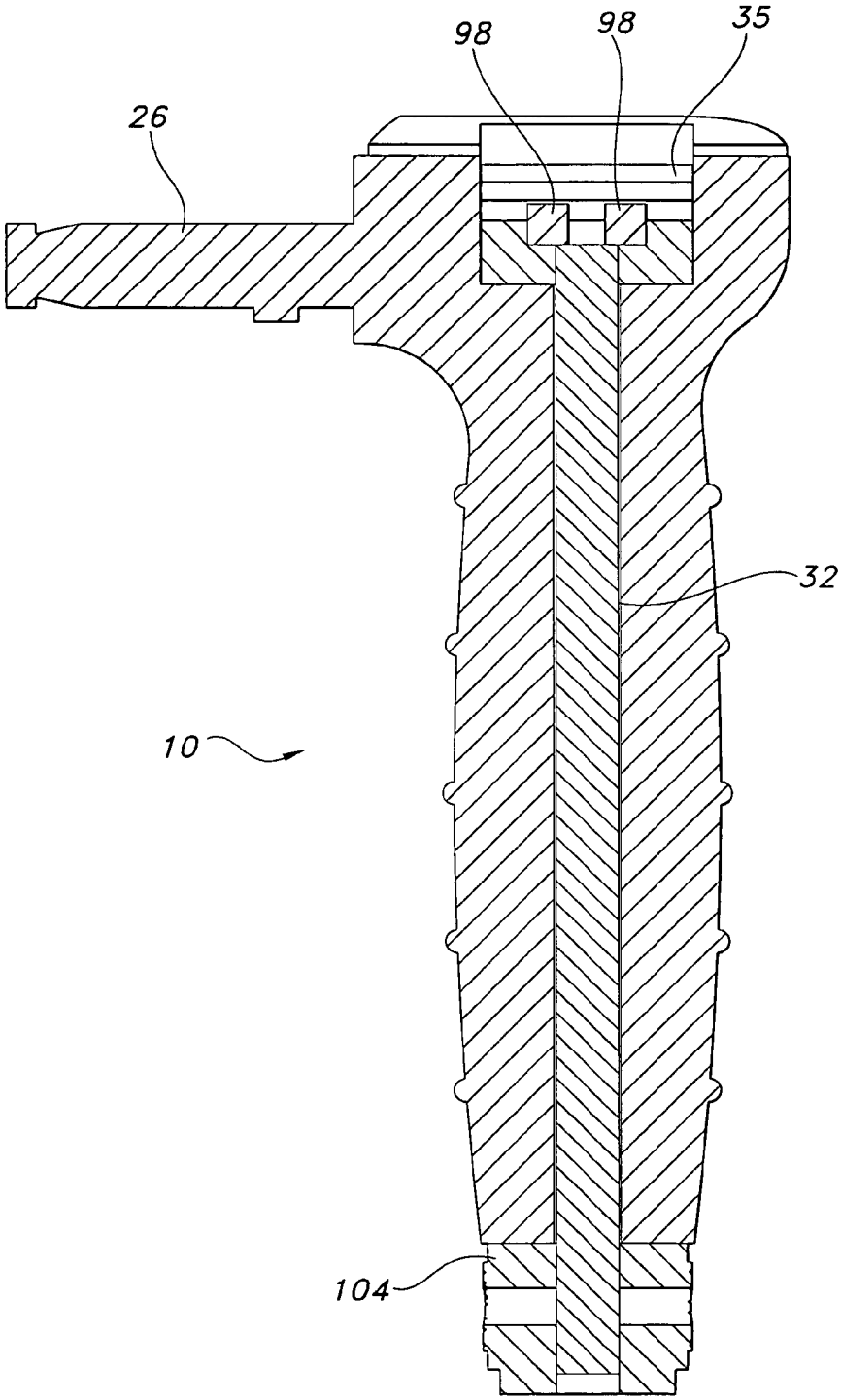
FIG. 6 is a cross sectional view of the bipod supporting grip assembly illustrating a section taken along line 6—6 in FIG. 2, in accordance with the present invention.

As shown in FIG. 5, an open ended recess or cavity 28 is formed in the mounting block segment upper surface 18. The cavity 28 generally is a substantially rectangularly or cubically shaped cavity having a series of substantially flat upstanding side walls 29 and a substantially flat bottom 31. A transverse, vertical bore or passage 32 is formed through the body of the mounting block 16 segment and extends from the bottom 31 of the cavity 28 along the transverse central axis of grip 110 through the bottom surface 21 of grip 110 (as best seen in FIG. 6).

A mounting yoke 35 is adapted to be received within the mounting block segment side walls 29 of the cavity 28 and functions as a means for attaching the mounting block segment 16 to the forearm stock portion of a firearm or other instrument (not shown) carrying mounting rail 120. Mounting yoke 35 is a substantially U-shaped block having inwardly facing vertical sidewalls 37, 38 and is formed from a metal such as steel or similar durable, high-strength material. Mounting yoke side walls 37 and 38 are spaced apart at a distance and one or more transverse steel or hardened metal fasteners such as elongate pins or bars 98 are received through transverse bores 40, 42 in side walls 37 and 38 of mounting yoke 35, thus limiting movement of the bipod mounting assembly in relation to the firearm.

The firearm preferably includes an elongate mounting rail such as a MIL-STD-1913 picatinny rail 120 having a plurality of transverse notches or grooves 122 and terminating, preferably, in an accessible proximal or distal end 124. For the embodiment of the bipod supporting grip assembly 10 illustrated in FIGS. 1–7, yoke 35 has side walls with inwardly facing V shaped sidewall grooves dimensioned to slidably receive and retain picatinny rail 12 having the plurality of evenly spaced transverse grooves 122 and a V shaped outer edges, as set forth in the mil-std specification cited above. Preferably, first and second transverse pins 98 are received in transverse sidewall apertures 130 aligned with the axes of parallel transverse grooves 132 in the yoke's bight and spaced at the same spacing of the picatinny rail's evenly spaced transverse grooves 122, such that pins 98, when installed in the yoke (as shown in FIGS. 1 and 6), will engage the picatinny rail's evenly spaced transverse grooves 122. Transverse pins 98 are preferably dimensioned to completely fill the transverse notches 122 in the rail and the yoke's sidewall apertures 130 are dimensioned to closely fit around, but slidably receive transverse pins 98.

It will be appreciated that FIG. 5 illustrates an exploded perspective view of a mounting block assembly that embodies principles of this invention. A 14 centimeter long threaded stud 49 projects downwardly from the bight portion 94 of the yoke assembly and is sized and positioned to extend through the grip bore 32 when the yoke assembly is inserted within the upwardly open recess 31. Once mounting block segment 16 is positioned over yoke 35 and yoke stud 49 projects through block bore 32, a steel or hardened metal threaded nut fastener 104 can be threadably attached to yoke stud 49, thus capturing and tightly securing mounting block segment 16 to mounting rail 120.

In particular, it should be noted that when the firearm's supporting rail 122 is secured within the yoke 35 and held captive via one or more transverse pins 98 and the yoke assembly 35 is installed within the upwardly open recess 31 of mounting block segment 16, the pins or bars 98 are captive and prevented from sliding transversely out of position by the walls 29 of block cavity 31 and the supporting picatinny rail 120 is thus firmly secured within the yoke assembly. Alternatively, a Weaver™ style rail can be employed, whereby the rail is tightly fastened to the yoke 35 by friction after the threaded stud 49 is drawn tightly into the fastening collar to affix the position of the mounting block 16.

A securing threaded nut fastener or body 104 is preferably formed with a knurled exterior surface. In the embodiment of FIGS. 1–7, the fastener body is generally cylindrical in shape and has an upper surface provided with a threaded bore. The threaded bore is sized and configured to receive the protruding threaded stud 49 of the yoke assembly 35 and to tighten onto the threaded stud when the securing bolt assembly is rotated. This tightening action causes the yoke assembly 35 to be drawn tightly into the upwardly open recess 31 and secure the mounting block 16 firmly to the rail 122.

Hand grip 110 is preferably made from fiber reinforced nylon, such as nylon 66, and has a tapered barrel-like shape with a plurality of spaced apart grip enhancing rings 120. Grip or handle 110 depends transversely from the mounting block segment 16 and has a plurality of evenly spaced circumferential outwardly projecting rings or surface features 120. Applicants have discovered checkering or bas-relief grooves or troughs quickly accumulated soil, dirt or debris and became slippery, and that by spacing surface features 120 at an axial distance of greater than about one centimeter, grip 110 will not clog with caked mud or dirt, and enhanced gripping power remains available for the user.

Figure 7:
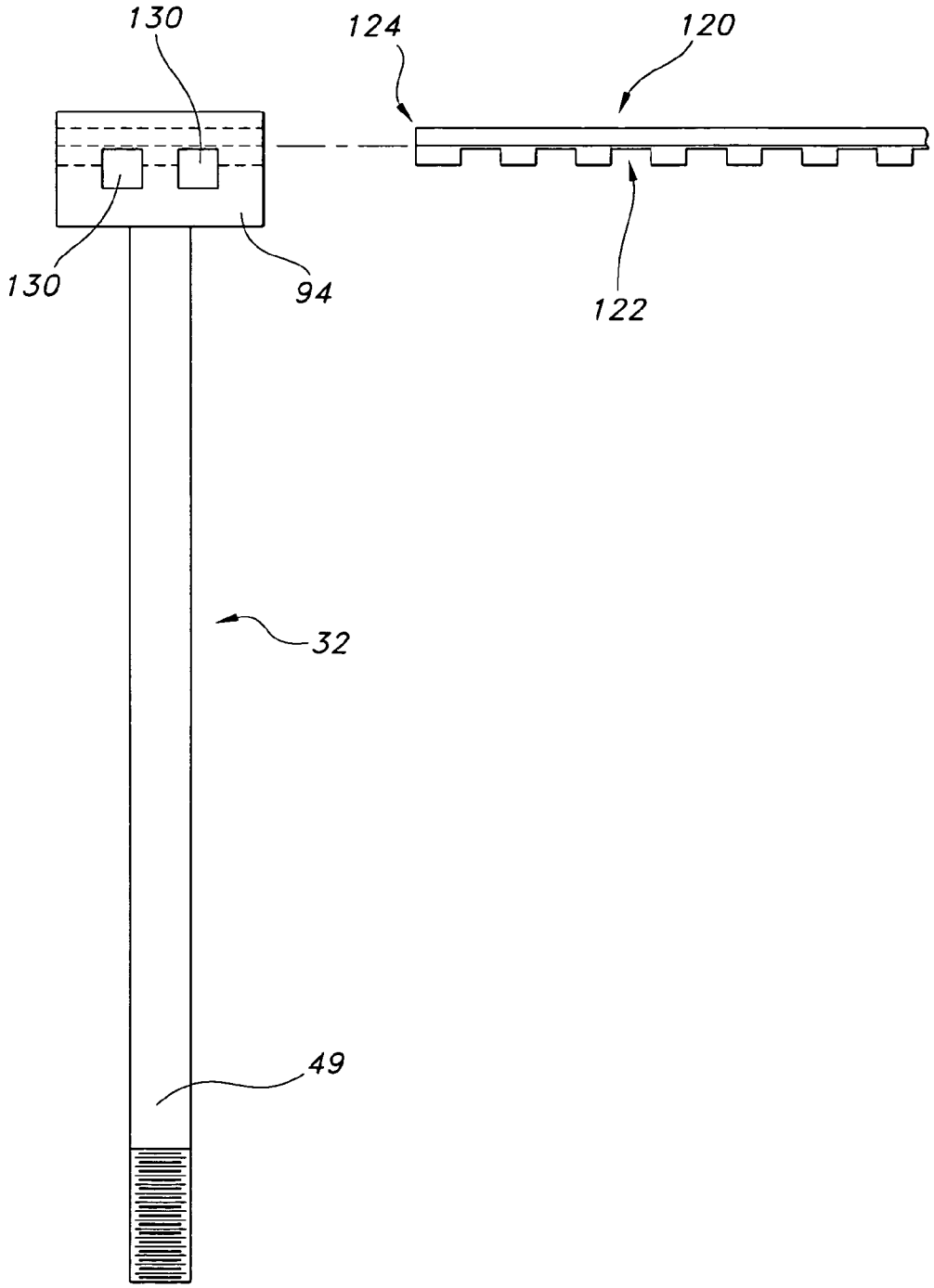
FIG. 7 is a side view, in elevation, of the grip assembly yoke shown in FIGS. 1 and 2, aligned with a mounting rail, in preparation for sliding the yoke over the rail, in accordance with the present invention.

In use, the disassembled yoke, as shown in FIG. 7, is aligned with the end 124 of rail 120, and rail 120 is slidably received between the side walls of yoke 35. The transverse apertures 98 in yoke 35 are aligned with selected rail transverse grooves 122 and the user may then insert one or both of the transverse pins 98, thereby fixing the fore/aft position of yoke 35 on rail 120. The user then slips threaded stud 49 into grip bore 32, moving grip 110 up until the distal or lower end of threaded stud extends below the bottom surface of grip 110. Knurled nut or fastener 104 is then threaded onto the threaded stud's distal end and tightened, thereby trapping transverse pins 98 within the grip assembly and locking the grip assembly onto mounting rail 120.

After installation, a bipod mounting frame (not shown) is received and mounted to the mounting block by the insertion of the mounting post 26 of the mounting block through the bore of the housing of the adjustable clamp or locking means of the bipod mounting frame. A bipod locking catch enables the quick attachment/detachment of the bipod mounting frame to the mounting post 26 as needed. Thereafter, with the bipod mounting frame connected to the forearm stock portion of the firearm, the bipod legs can be folded into a raised non-operative position when not in use, and can quickly be lowered to an operative, ground engaging position when needed.

It will be understood that while the foregoing relates to a preferred embodiment of the present invention, various modifications, additions and changes may be made thereto without departing from the spirit and scope of the invention as set forth in the claims.

Further, it will be understood by those skilled in the art that while the present invention has been disclosed for use primarily with the Versa-Pod® bipod or a Parker-Hale style bipod assembly, the present invention also can be used for mounting the types of bipods having a bipod leg frame that is releasably mountable to a mounting block on a firearm.

The forgoing description of the invention is necessarily of a detailed nature so that a specific embodiment of its best mode is set forth. Having described preferred embodiments of a new and improved method and apparatus, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. An accessory mount and grip assembly adapted for releasable attachment to an elongated rail having V shaped sides and a plurality of evenly spaced transverse notches or grooves, comprising:

a yoke having first and second sidewalls and a bight carrying a transversely projecting stud; said yoke bight having at least one transverse groove, and said yoke first and second side walls having a transverse aperture aligned with said yoke bight's groove;

a grip having a proximal mounting block with a recess dimensioned to receive said yoke, said grip having a transversely projecting handle having a distal end and including a bore there through, said grip bore being terminated proximally in said mounting block recess and terminated distally in said handle's distal end;

wherein said grip bore is dimensioned to receive said yoke's transversely projecting stud; and a fastener adapted to secure said grip on said yoke stud.

2. The accessory mount of claim 1, wherein said yoke stud carries threads on said stud's distal end, and wherein said fastener is a threaded nut adapted to pull said stud and said yoke down into said mounting block recess when tightened.

3. The accessory mount of claim 1, wherein said yoke side walls each have first and second through holes symmetrically spaced to oppose one another, and wherein said bight has first and second substantially parallel transverse grooves aligned with said side wall's first and second through holes.

4. The accessory mount of claim 1, wherein said grip handle is made from a fiber reinforced polymer.

5. The accessory mount of claim 1, wherein said grip handle provides an exterior gripping surface including a plurality of evenly spaced circumferential outwardly projecting rings or surface features.

6. A grip assembly adapted for releasable attachment to an elongated rail having transversely projecting features on the rail sides and a plurality of evenly spaced transverse notches or grooves, comprising:

a yoke having first and second sidewalls dimensioned to close fit to and slidably receive the rail's transversely projecting features and a bight carrying a transversely projecting stud;

a grip having a proximal mounting block with a recess dimensioned to receive said yoke, said grip having a transversely projecting handle having a distal end and including a bore there through, said grip bore extending from said mounting block recess to said handle's distal end;

wherein said grip bore is dimensioned to receive said yoke's transversely projecting stud; and a fastener adapted to secure said grip on said yoke stud.

7. The grip assembly of claim 6, wherein said yoke stud carries threads on said stud's distal end, and wherein said fastener is a threaded nut adapted to pull said stud and said yoke down into said mounting block recess when tightened.

8. The grip assembly of claim 7, wherein said yoke side walls each have first and second through holes symmetrically spaced to oppose one another along first and second parallel transverse axes, and wherein said bight has first and second substantially parallel transverse grooves aligned with said side wall's first and second through holes.

9. The grip assembly of claim 8, wherein said grip handle is made from a fiber reinforced polymer.

10. The grip assembly of claim 9, wherein said grip handle provides an exterior gripping surface including a plurality of evenly spaced circumferential outwardly projecting rings or surface features.

11. A method for mounting a grip assembly on a rail, comprising the steps of:

(a) providing a yoke having first and second sidewalls dimensioned to close fit to and slidably receive the rail's transversely projecting features and a bight carrying a transversely projecting stud;

(b) providing a grip having a proximal mounting block with a recess dimensioned to receive said yoke, said grip having a transversely projecting handle having a distal end and including a bore there through, said grip bore extending from said mounting block recess to said handle's distal end; wherein said grip bore is dimensioned to receive said yoke's transversely projecting stud; and (c) providing a fastener adapted to secure said grip on said yoke stud;

(d) sliding said yoke over said rail, to engage said rail's transversely projecting features;

(e) inserting said yoke's transverse stud into and through said grip's bore; and (f) fastening said fastener on said yoke stud.

12. The method of claim 11, wherein step (d) further comprises:

(d1) aligning apertures in the yoke sidewall with transverse notches on the rail; and (d2) inserting transverse pins through said yoke sidewall apertures, to engage said rail's transverse notches.

* * * * *